US009862564B2

(12) United States Patent
Cooper et al.

(10) Patent No.: US 9,862,564 B2
(45) Date of Patent: Jan. 9, 2018

(54) CUTTER ASSEMBLY FOR STRETCHED YARN

(71) Applicant: SHAW INDUSTRIES GROUP, INC., Dalton, GA (US)

(72) Inventors: Chris Cooper, Aiken, SC (US); Larry B. Sims, Dalton, GA (US); Kevin Lamar Cowart, Aiken, SC (US)

(73) Assignee: Columbia Insurance Company, Omaha, NE (US)

( * ) Notice: Subject to any disclaimer, the term of this patent is extended or adjusted under 35 U.S.C. 154(b) by 477 days.

(21) Appl. No.: 14/524,520

(22) Filed: Oct. 27, 2014

(65) Prior Publication Data

US 2015/0113777 A1 Apr. 30, 2015

Related U.S. Application Data

(60) Provisional application No. 61/895,824, filed on Oct. 25, 2013.

(51) Int. Cl.
*B65H 54/71* (2006.01)
*B65H 51/22* (2006.01)

(52) U.S. Cl.
CPC ..... *B65H 54/71* (2013.01); *B65H 51/22* (2013.01); *B65H 2701/31* (2013.01)

(58) Field of Classification Search
CPC .... B65H 54/71; B65H 51/22; B65H 2701/31; D03D 45/50; D03D 49/70; D06H 7/00; D06H 7/14; D06H 7/02; B26D 1/015; B26D 1/045; B26D 1/125; B26D 1/255; B26D 1/265; B26D 1/45; B26D 1/455
USPC ..... 26/7, 11, 12; 28/170, 172.1, 172.2, 202, 28/240; 139/263, 302; 83/902
See application file for complete search history.

(56) References Cited

U.S. PATENT DOCUMENTS 1,775,034 A * 9/1930 Burdett ..... D03D 49/70 139/266
1,776,229 A * 9/1930 Burdett ..... D03J 1/226 139/303
2,396,215 A 3/1946 Turner
2,572,143 A * 10/1951 Hazelton ..... D05B 65/00 112/293
2,575,015 A * 11/1951 Hendricks ..... B65H 54/71 242/487.1
2,667,187 A * 1/1954 Jefferson ..... D03D 49/70 139/196.1

(Continued)

FOREIGN PATENT DOCUMENTS

CN 2811241 Y 8/2006
EP 0157654 A1 10/1985

(Continued)

*Primary Examiner* — Amy Vanatta
(74) *Attorney, Agent, or Firm* — Ballard Spahr LLP

(57) ABSTRACT

An assembly and method for automated cutting of undesired stretched yarn in a yarn system. Stretched yarn can hang away from the yarn system differently than desired yarn. A cutter head is positioned a predetermined distance relative to yarn traveling through the yarn system so that the stretched yarn is cut by the cutter head and the desired yarn passes the cutter head without being cut. A plurality of cutter heads can be used to cut stretched yarn hanging away from the yarn system in different locations.

19 Claims, 5 Drawing Sheets

(56) References Cited

U.S. PATENT DOCUMENTS

| | | | | | |
|---|---|---|---|---|---|
| 2,920,592 | A * | 1/1960 | Ball | D05B 65/00 | 112/288 |
| 3,112,774 | A * | 12/1963 | Bostic | D03D 45/50 | 139/263 |
| 3,141,431 | A * | 7/1964 | Miller | D05B 37/04 | 112/295 |
| 3,334,477 | A * | 8/1967 | Morin | B65H 69/061 | 57/22 |
| 3,380,483 | A * | 4/1968 | Bridgham | D03D 49/70 | 139/263 |
| 3,444,900 | A * | 5/1969 | Schaffer | D03D 47/00 | 139/437 |
| 3,513,883 | A * | 5/1970 | Kingdon | D03D 47/125 | 139/263 |
| 3,526,348 | A * | 9/1970 | Morrocco | B65H 54/71 | 225/20 |
| 3,776,480 | A | 12/1973 | Lawson | | |
| 3,777,610 | A | 12/1973 | Spaller, Jr. | | |
| 3,854,356 | A | 12/1974 | Okreglak | | |
| 3,974,972 | A | 8/1976 | Egli et al. | | |
| 4,014,476 | A | 3/1977 | Turk et al. | | |
| 4,033,150 | A * | 7/1977 | Mishcon | D04B 1/22 | 28/170 |
| 4,048,884 | A | 9/1977 | Winn, Jr. | | |
| 4,065,837 | A | 1/1978 | Gierse et al. | | |
| 4,083,279 | A | 4/1978 | Wester et al. | | |
| 4,108,388 | A | 8/1978 | Schar | | |
| 4,143,683 | A * | 3/1979 | Scheidecker | D03D 47/34 | 139/450 |
| 4,202,286 | A | 5/1980 | Freire Costas | | |
| 4,271,568 | A | 6/1981 | Durville et al. | | |
| 4,274,346 | A | 6/1981 | Carnaby | | |
| 4,343,069 | A | 8/1982 | McLuskie et al. | | |
| 4,602,475 | A | 7/1986 | Piesczek | | |
| 4,638,955 | A | 1/1987 | Schippers et al. | | |
| 4,694,761 | A | 9/1987 | Golda | | |
| 4,716,801 | A | 1/1988 | Spaller, Jr. | | |
| 4,817,896 | A | 4/1989 | Busenhart et al. | | |
| 4,938,268 | A | 7/1990 | Shaw | | |
| 5,033,345 | A | 7/1991 | Schnitzer | | |
| 5,078,032 | A | 1/1992 | Gerlach | | |
| 5,369,852 | A | 12/1994 | Higashinaka | | |
| 5,839,342 | A | 11/1998 | Cope et al. | | |
| 6,050,517 | A | 4/2000 | Dobrescu et al. | | |
| 6,189,826 | B1 | 2/2001 | Oberstrass | | |
| 6,375,114 | B1 | 4/2002 | Mayer et al. | | |
| 6,457,668 | B1 | 10/2002 | Jaschke et al. | | |
| 6,497,045 | B1 | 12/2002 | Forgani | | |
| 6,694,565 | B2 | 2/2004 | Medeiros | | |
| 7,150,426 | B2 | 12/2006 | Huttunen | | |
| 7,252,026 | B2 | 8/2007 | Kempski et al. | | |
| 7,578,221 | B2 | 8/2009 | Billingsley | | |
| 8,272,341 | B2 | 9/2012 | Konig et al. | | |
| 8,302,373 | B2 | 11/2012 | Lee et al. | | |
| 2005/0028335 | A1 * | 2/2005 | Bachmann | D03J 1/13 | 28/203.1 |

FOREIGN PATENT DOCUMENTS

| | | | |
|---|---|---|---|
| GB | 761595 | A | 11/1956 |
| GB | 1504519 | A | 3/1978 |
| JP | 6093536 | A | 4/1994 |
| KR | 20080031020 | A | 4/2008 |

* cited by examiner

CUTTER ASSEMBLY FOR STRETCHED YARN

CROSS-REFERENCE TO RELATED APPLICATION

This application claims the benefit of U.S. Provisional Application No. 61/895,824, filed Oct. 25, 2013, which is hereby incorporated herein by reference in its entirety.

FIELD OF THE INVENTION

This invention relates generally to yarn cutting assemblies and methods for use in yarn and other textiles manufacturing and/or processing. More specifically, assemblies and methods are provided for the automated cutting of loose or stretched yarn.

BACKGROUND OF THE INVENTION

In the manufacture and processing of threads and yarn and in the weaving of cloth, long substantially continuous lengths or strands of thread or yarn are handled and processed by passing the strands through various handling and/or treating apparatus of a yarn system. For example, a yarn accumulator can be configured to accumulate and contain processed yarn in preparation for winding the yarn onto spools or bobbins.

During manufacturing and handling, portions of the yarn can be undesirably stretched in the process. Conventionally, an operator would manually cut the stretched yarn when observed to prevent the stretched yarn from being used as first quality yarn. This method has obvious manpower limitations. The demands of the operator's job requirements typically do not allow for thorough inspection for stretched yarn. Unless an operator happened to be standing near the yarn system during an instance of stretched yarn, most stretched yarn would continue processing as first quality yarn. In addition, the degree of stretch can vary as it is determined subjectively by the operator.

When this stretched yarn is woven or tufted into a finished product, such as, for example and without limitation, carpet, the variations in the yarn can be readily apparent. Thus, there is a need in the art for an automated means of cutting yarn that has been undesirably stretched.

SUMMARY OF THE INVENTION

In accordance with the purpose(s) of this invention, as embodied and broadly described herein, this invention, in one aspect, relates to assemblies, systems and methods for automated cutting of loose and/or stretched yarn.

Yarn being processed in a yarn system can travel in a yarn direction. For example, yarn being processed can be wrapped around or otherwise accumulated in a yarn accumulator. Stretched or loose yarn can hang away from the yarn system, including the yarn accumulator, at a different position relative than unstretched, first quality yarn.

In one aspect, the assembly for automatically cutting stretched yarn comprises at least one cutter head configured to cut yarn and at least one mounting arm configured to position the at least one cutter head a predetermined distance from a portion of the yarn system. In another aspect, the at least one mounting arm can have a proximal end coupled to a portion of the yarn system and a distal end coupled to a portion of the at least one cutter head. As yarn travels towards an exit end of the yarn system, stretched yarn hanging away from the yarn system can be cut by the at least one cutter head.

In one aspect, the at least one cutter head comprises a cutter body and a cutting member. The cutting member can be substantially planar, such as a blade and the like. In another aspect, the cutting member can have a cutting edge positioned along a cutter longitudinal axis.

In a further aspect, the at least one cutter head can comprise a plurality of cutter heads. Similarly, the at least one mounting arm can comprise a plurality of mounting arms. For example, a first cutting head of the plurality of cutting heads can be coupled to a first mounting arm of the plurality of mounting arms, a second cutting head of the plurality of cutting heads can be coupled to a second mounting arm of the plurality of mounting arms and so on. In this aspect, the cutter longitudinal axis of the first cutter head of the plurality of cutter heads can be substantially parallel to the cutter longitudinal axis of the second cutter head. Alternatively, the first cutter head of the plurality of cutter heads can be positioned so that the cutter longitudinal axis is a substantial mirror image of the cutter longitudinal axis of the second cutter head with respect to a plane that bisects the yarn system along a longitudinal axis of the yarn system.

In yet another aspect, the at least one mounting arm comprises a mounting finger extending from the distal end of the at least one mounting arm to position the cutter head in a desired position and/or orientation relative to the yarn system. In one aspect, the mounting finger can have a longitudinal axis extending at a first finger angle relative to a longitudinal axis of the mounting arm. In another aspect, the mounting finger can be positioned in a plane at a second finger angle relative to the longitudinal axis of the mounting arm. That is, the mounting finger can extend away from the respective mounting arm at a first finger angle and the mounting finger can be in a plane that is at a second finger angle relative to the respective mounting arm. The mounting finger then can be configured to position a cutter head in a desired position and orientation relative to the yarn system.

In use, yarn travels in the yarn direction through the yarn system. Undesired loose or stretched yarn can hang off the yarn system a predetermined distance away from yarn that is first quality. In one aspect, the at least one cutter head can be positioned relative to a frame of the system so that as yarn travels in the yarn direction, stretched yarn can be urged into contact with the cutting member of the at least one cutter head to be cut automatically. First quality yarn (unstretched yarn) can travel past the at least one cutter head without contacting the cutting member.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DESCRIPTION OF THE PREFERRED EMBODIMENTS

Figure 1:
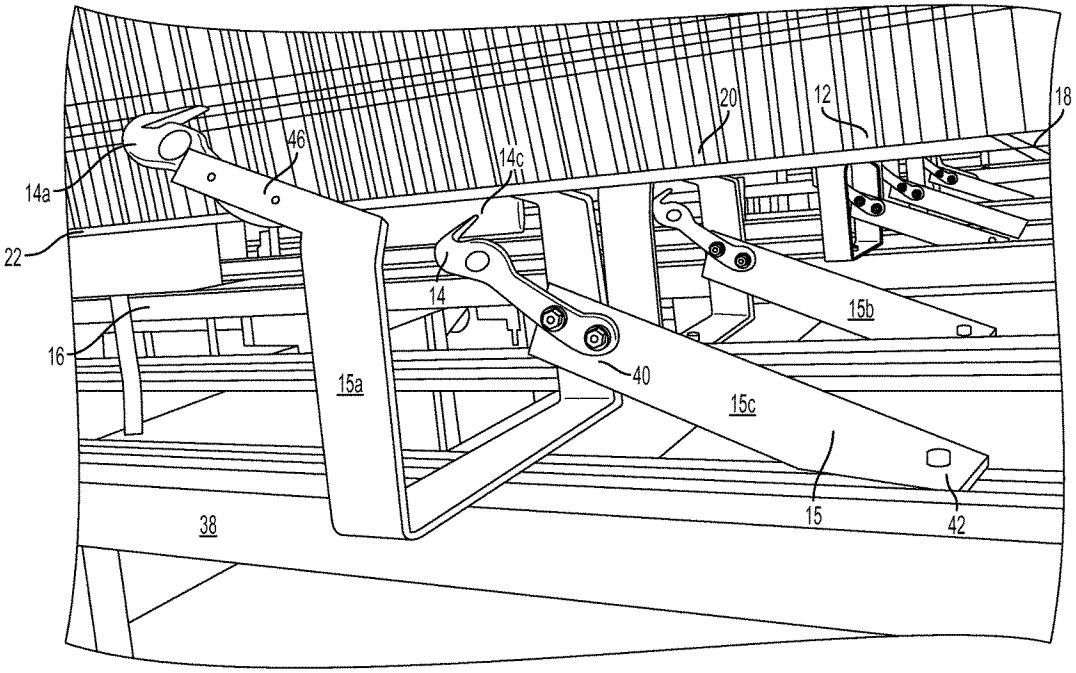
FIG. 1 is a side perspective view of a yarn accumulator of a yarn system and one embodiment of a cutter assembly for stretched yarn comprising at least one cutter head and at least one mounting arm.

The present invention may be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a yarn" can include two or more such yarns unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

For convenience and clarity, as used herein, the term "yarn system" can refer to any apparatus used to process yarn in a yarn system, such as a yarn accumulator and the like.

The present invention may be understood more readily by reference to the following detailed description of preferred embodiments of the invention and the examples included therein and to the Figures and their previous and following description.

In one broad aspect, the present invention comprises assemblies and methods for cutting yarn, thread and/or other textiles during manufacturing and/or processing. More specifically, assemblies and methods are provided for automated cutting of loose or stretched yarn that has been stretched beyond a predetermined amount.

Figure 2:
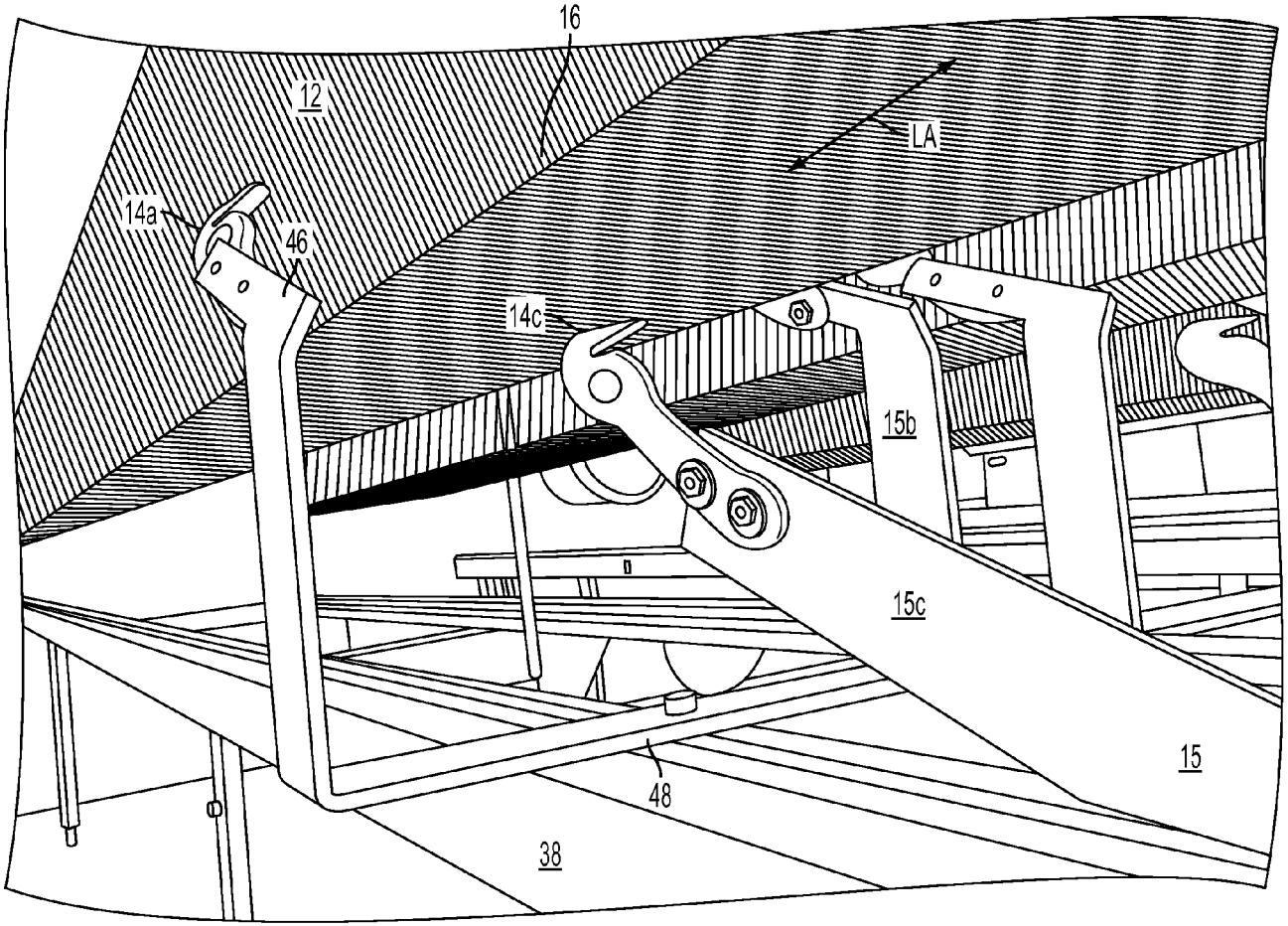
FIG. 2 is front perspective view of the cutter assembly of FIG. 1, looking towards the exit end of the yarn system.
Figure 3:
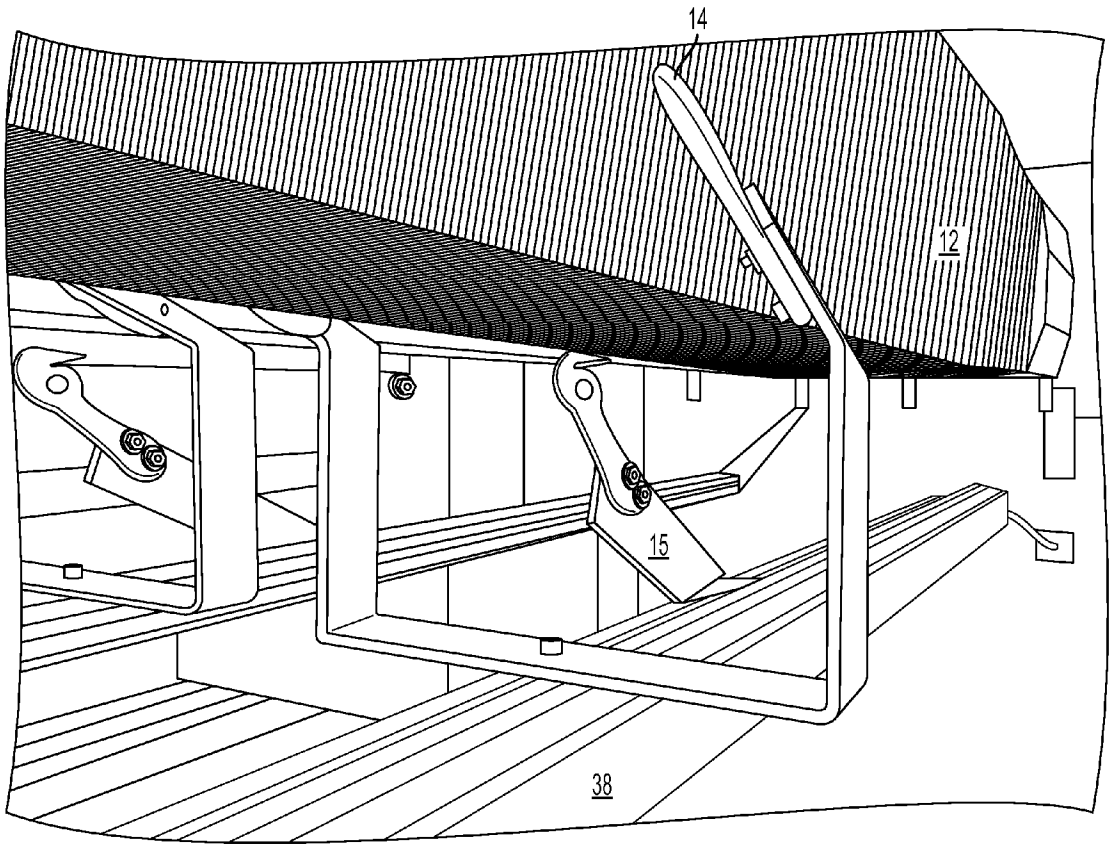
FIG. 3 is rear perspective view of the cutter assembly of FIG. 1, looking towards the entry end of the yarn system.

With reference to FIGS. 1-3, in one aspect, the cutter assembly 10 for yarn 12 comprises at least one cutter head 14 coupled to at least one mounting arm 15 configured to position the at least one cutter head a predetermined distance from a yarn system 16. As known in the art, the yarn system can be a yarn accumulator configured to accumulate yarn for further processing. For example, the yarn system 16 can be an elongate apparatus having a yarn system longitudinal axis $L_A$ and an outer perimeter around which yarn 12 can be wrapped. In use, yarn can enter an entry end 18 of the system and can be urged through a central portion 20 of the system towards an exit end 22 of the yarn system 16 in a yarn direction.

Figure 4:
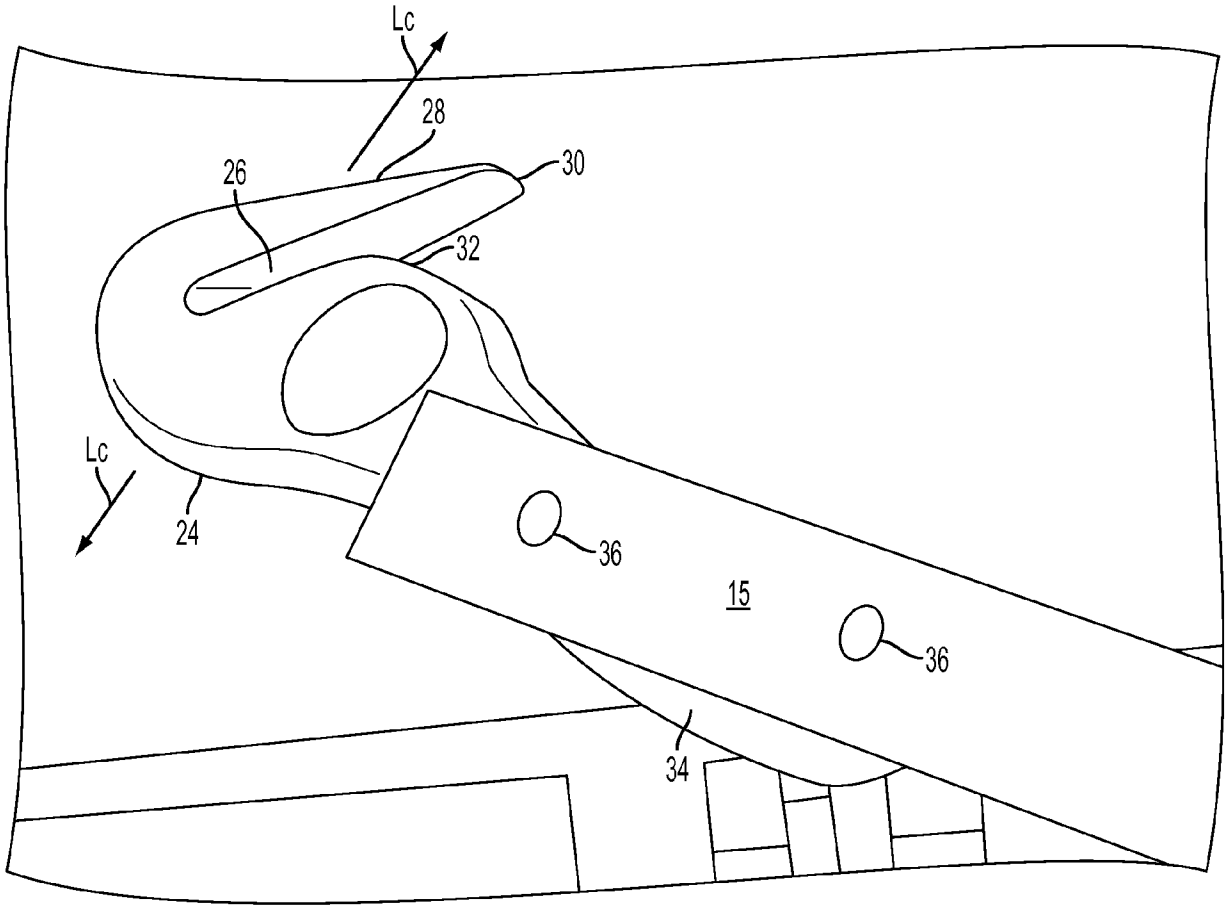
FIG. 4 is a perspective view of the at least one cutter head of FIG. 1, according to one aspect.

As illustrated in FIG. 4, the at least one cutter head 14 can comprise a cutter body 24 and a cutting member 26, such as a blade and the like, configured to cut yarn 12. In one aspect, the cutter body can be configured to hold at least a portion of the cutting member. In another aspect, the cutter body 24 can be sized and shaped to direct stretched and/or loose yarn from the yarn system 16 towards the cutting member. In still another aspect, the cutter body 24 can comprise a yarn guide 28 that tapers from the cutting member to a snagging end 30 of the cutter body. In this aspect, the snagging end of the yarn guide can be configured to snag loose yarn 12 as the yarn is urged along the yarn system 16. The taper of the yarn guide 28 can then direct the yarn towards a cutting edge 32 of the cutting member 26 for cutting the yarn. In another aspect, a proximal end 34 of the cutter body can be configured for attachment to a portion of the mounting arm 15. For example, the proximal end of the cutter body can be coupled to the mounting arm with bolts 36, welds and the like.

According to one aspect, at least a portion of the cutting member 26 of the cutter head 14 can be substantially planar. In another aspect, the cutting edge 32 of the cutting member can be positioned along a cutter longitudinal axis $L_C$.

Referring again to FIGS. 1-3, in one aspect, the at least one mounting arm 15 can be configured to position the cutting member 26 of the at least one cutter head 14 a predetermined distance and/or at a predetermined orientation relative to the yarn 12 and/or the yarn system 16. In another aspect, the at least one mounting arm can couple the at least one cutter head 14 to a portion of a structure or frame 38 of the yarn system. For example, a distal end 40 of the mounting arm 15 can be configured for attachment to the cutter body 24, and a proximal end 42 of the mounting arm can be configured for attachment to the frame of the yarn system 16. In one aspect, the at least one mounting arm can be formed from metallic, wooden and/or polymeric materials. In another aspect, the at least one mounting arm 15 can be formed from a 2 inch×¼ inch bar.

Figure 6:
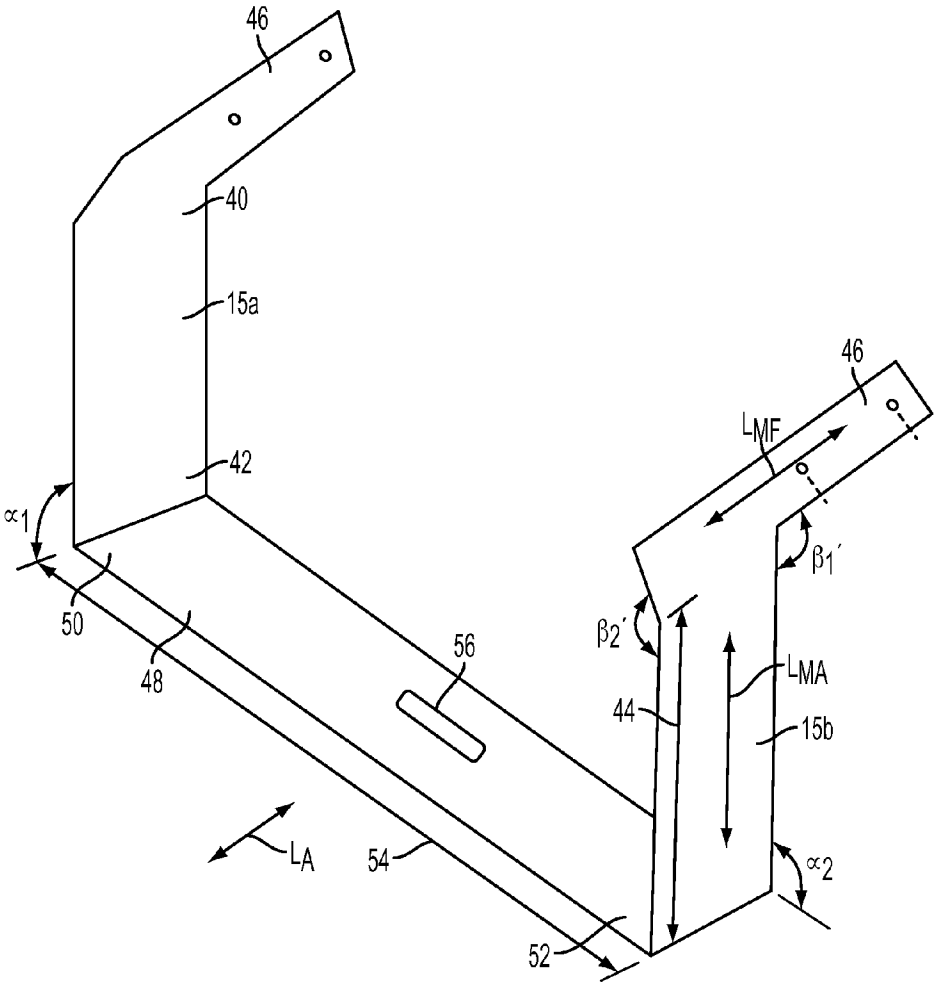
FIG. 6 is a perspective view of the at least one mounting arm of FIG. 1, according to a second aspect.
Figure 5:
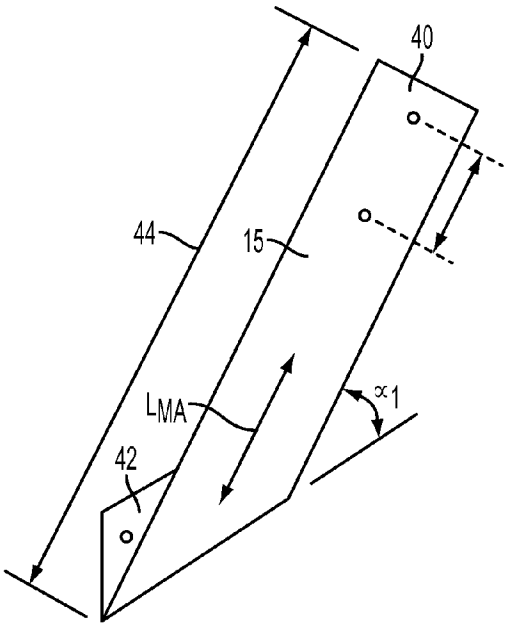
FIG. 5 is a perspective view of the at least one mounting arm of FIG. 1, according to a first aspect.

With reference now to FIGS. 1, 5 and 6, in one aspect, the at least one mounting arm 15 can be configured so that when the proximal end 42 of the mounting arm is coupled to the frame 38 of the yarn system 16, the distal end 40 of the mounting arm extends away from the frame. In one aspect, the at least one mounting arm can be positioned so that the longitudinal axis $L_{MA}$ of the at least one mounting arm is substantially parallel to a plane bisecting the yarn system 16 along the longitudinal axis $L_A$ of the system. In a further aspect, the at least one mounting arm 15 can be positioned so that the longitudinal axis $L_{MA}$ of the at least one mounting arm is a first arm angle $\alpha_1$ relative to the longitudinal axis $L_A$ of the system. In this aspect, the first arm angle $\alpha_1$ between the longitudinal axis $L_{MA}$ of the at least one mounting arm 15 and the longitudinal axis $L_A$ of the system can be less than about 10 degrees, about 10 degrees, about 20 degrees, about 30 degrees, about 40 degrees, about 45 degrees, about 50 degrees, about 60 degrees, about 70 degrees, about 80 degrees, or about 90 degrees. In another aspect, the at least one mounting arm 15 can be positioned so that the longitudinal axis $L_{MA}$ of the at least one mounting arm is at a second arm angle $\alpha_2$ relative to the plane bisecting the yarn system 16 along the longitudinal axis $L_A$ of the system. In this aspect, the second arm angle $\alpha_2$ between the longitudinal axis $L_{MA}$ of the at least one mounting arm 15 and the plane bisecting the yarn system 16 along the longitudinal axis $L_A$ of the system can be less than about 10 degrees, about 10 degrees, about 20 degrees, about 30 degrees, about 40 degrees, about 45 degrees, about 50 degrees, about 60 degrees, about 70 degrees, about 80 degrees, or about 90 degrees.

The length 44 of the mounting arm can be predetermined so that in use, the at least one cutter head is a desired distance from the yarn and/or yarn system. For example, the length 44 of the mounting arm can be about 1 inch, about 2 inches, about 3 inches, about 4 inches, about 5 inches, about 6 inches, about 7 inches, about 8 inches, about 9 inches, about 10 inches, about 11 inches, about 12 inches, about 13 inches, about 14 inches, or greater than about 14 inches.

In one aspect, and as illustrated in FIG. 6, the at least one mounting arm 15 can comprise a mounting finger 46 coupled to or formed integrally with the distal end 40 of the mounting arm. In this aspect, the at least one mounting finger can extend from the mounting arm and can be configured for attachment to the at least one cutter head 14 to position the cutter head in a desired position relative to the yarn system 16 and/or the yarn 12 in the yarn system. In another aspect, the mounting finger can be positioned at a compound angle relative to the respective mounting arm. That is, a longitudinal axis $L_{MF}$ of the mounting finger 46 can extend from the distal end of the mounting arm at a first finger angle $\beta_1$ relative to the longitudinal axis $L_{MA}$ of the mounting arm, and the mounting finger 46 can simultaneously extend from the distal end 40 of the mounting arm in a plane positioned at a second finger angle $\beta_2$ relative to the longitudinal axis $L_{MA}$ of the mounting arm 15. In this aspect, the first finger angle $\beta_1$ and/or the second finger angle $\beta_2$ can be about 0 degrees, about 5 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees and about 90 degrees.

Optionally, in one aspect, the at least one cutter head 14 can comprise a plurality of cutter heads. In this aspect, the plurality of cutter heads can comprise a first cutter head 14*a*, a second cutter head 14*b*, and a third cutter head 14*c*, though any number of cutter heads are contemplated. For example, the cutter system 10 can comprise one, two, three four, five, six or more than six cutter heads. Each cutter head can be positioned and/or orientated on the at least one mounting arm 15 such that each cutter head of the plurality of cutter heads is a predetermined distance/and or orientation from the yarn 12 and/or yarn system 16. In another aspect, the at least one mounting arm 15 can comprise a plurality of mounting arms. In this aspect, the plurality of mounting arms can comprise a first mounting arm 15*a*, a second mounting arm 15*b*, and a third mounting arm 15*c*, though any number of mounting arms are contemplated. For example, the cutter system 10 can comprise one, two, three, four, five, six or more than six mounting arms.

In a further aspect, each mounting arm 15 of the plurality of mounting arms can be formed substantially the same, though at least one mounting arm of the plurality of mounting arms can be different than the other mounting arms. Alternatively, at least two mounting arms of the plurality of mounting arms can be substantial mirror images of each other. In still another aspect, each mounting arm 15 of the plurality of mounting arms can be substantially the same, different from and/or mirror images of each other.

In one aspect and as illustrated in FIG. 6, the plurality of mounting arms 15 can comprise an elongate base member 48 configured to couple at least two mounting arms 15*a*, 15*b* of the plurality of mounting arms to the frame 38 of the yarn system 16. The base member can be an elongate member having a first end 50, a second end 52 and a length 54 of about 4 inches, about 5 inches, about 6 inches, about 7 inches, about 8 inches, about 9 inches, about 10 inches, about 11 inches, about 12 inches, about 13 inches, about 14 inches, about 15 inches, about 16 inches, about 17 inches, about 18 inches, about 19 inches, about 20 inches, or greater than about 20 inches. In another aspect, a mounting slot 56 can be defined in a portion of the base member 48. In this aspect, the mounting slot can have an elongate length of between about 1 and 5 inches, between about 2 and 4 inches, or about 3 inches. The mounting slot is configured so that a bolt can extend through the slot to the frame 38 of the yarn system 16 while allowing the base member to be centered or positioned as desired relative to the longitudinal axis $L_A$ of the system.

If the at least one mounting arm 15 comprises a plurality of mounting arms, each mounting arm can be formed from individual pieces that can be separately attached to the frame 38 of the yarn system 16. Alternatively, in one aspect, at least two mounting arms 15 of the plurality of mounting arms can be formed or coupled together with the base member 48 and can be attached to the frame of the yarn system as a single, monolithic unit, as illustrated in FIG. 6.

To assemble the cutter assembly 10, the at least one cutter head 14 can be coupled to the at least one mounting arm 15 with bolts 36, welds, fasteners and the like. The at least one mounting arm can be coupled to the frame 38 of the yarn system 16 such that the cutting edge 32 of the cutting member 26 of the cutter head can be exposed to yarn 12 traveling in the yarn direction. In one aspect, the at least one cutter head can be positioned relative to the frame of the yarn system so that loose yarn (yarn that has been stretched beyond a predetermined level and is therefore not first quality yarn) is urged into contact with the cutter head to be cut.

In another aspect, the cutting member 26 can be positioned so that the cutter longitudinal axis $L_C$ of the cutting edge 32 is substantially parallel to the longitudinal axis $L_A$ of the yarn system 16. Alternatively, the cutting member can be positioned so that the cutter longitudinal axis $L_C$ of the cutting edge is at an acute angle relative to the longitudinal axis $L_A$ of the system. That is, the cutting member 26 can be positioned so that an angle formed between the longitudinal axis $L_C$ of the cutting edge 32 and the longitudinal axis $L_A$ of the system 16 is about 0 degrees, about 5 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees and about 90 degrees. As the yarn travels in the yarn direction, any yarn guided by the yarn guide to the cutting edge 26 will be urged into contact with the cutting edge and the yarn can be cut to indicate that the yarn is not first quality yarn.

In one aspect, if the at least one cutter head 14 comprises a plurality of cutter heads, each cutter head can be coupled to the at least one mounting arm 15 and the at least one mounting arm can be coupled to the frame 38 of the yarn system 16. For example, if the plurality of cutter heads 14 comprises three cutter heads, the at least one mounting arm can comprise three mounting arms. In this example, the first cutter head 14*a* can be coupled to the first mounting arm 15*a*, the second cutter head 14*b* can be coupled to the second mounting arm 15*b* and the third cutter head 14*c* can be coupled to the third mounting arm 15*c*. It is of course contemplated however that 0, 2, 3, 4, 5 or more cutter heads can be coupled to a single mounting arm.

Each cutter head 14 of the plurality of cutter heads can be positioned a predetermined distance from the yarn system 16 and/or yarn 12 in the yarn system. In one aspect, each cutter head 14 of the plurality of cutter heads can be positioned an equal distance from the yarn 12 and/or the yarn system 16. Alternatively, at least one cutter head 14 of the plurality of cutter heads can be positioned a different distance from the yarn 12 and/or the yarn system 16 than another cutter head. For example, at least a portion of the cutting edge 32 of each cutter head can be positioned about ¼ inch from the first quality yarn of the yarn system. In other example, at least a portion of the cutting edge of the cutting member 26 can be positioned about ½, about ¾ inch, about 1 inch, about1¼ inch, about1½ inch, about1¾ inch, about 2 inches, or more than about 2 inches from the first quality yarn 12 of the yarn system 16.

In one aspect, the cutter longitudinal axis $L_C$ of the cutting edge 32 of at least one cutter head 14 of the plurality of cutter heads can be positioned substantially parallel to the cutter longitudinal axis of another cutter head. That is, the cutter longitudinal axis of at least two cutter heads 14 of the plurality of cutter heads can be substantially parallel to each other. In another aspect, the cutter longitudinal axis $L_C$ of each cutter head of the plurality of cutter heads can be substantially parallel to each other. Optionally, in one aspect, the cutter longitudinal axis $L_C$ of at least one cutter head 14 of the plurality of cutter heads can be positioned so that it is a substantial mirror image of the cutter longitudinal axis of another cutter head with respect to a plane that bisects the yarn system 16 along the longitudinal axis $L_A$ of the system. As can be appreciated then, each cutting member 26 can be positioned substantially parallel to another cutting member, or at any angle relative to another cutting member.

In use, yarn 12 travels in the yarn direction along the yarn system 16 from the entry end 18 towards the exit end 22 of the system. Loose yarn (yarn that has been stretched beyond a predetermined level and is therefore undesired) can hang off the yarn system a predetermined distance away from yarn 12 that is first quality. In one aspect, the at least one cutter head 14 can be positioned relative to the frame of the system so that loose yarn is cut. That is, as yarn travels in the yarn system, stretched and/or loose yarn hanging away from the first quality yarn can be guided by the taper of the yarn guide 28 towards the cutting edge 32 of the at least one cutter head 14 to be cut automatically. Yarn that is not stretched (i.e., first quality yarn) can pass the cutter head without being cut. A plurality of cutter heads can be positioned as desired relative to the system so that loose yarn hanging away from the sides and/or the bottom of the system can be cut without requiring intervention by an operator.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An assembly for automatically cutting stretched yarn traveling in a yarn direction along a longitudinal axis of a yarn system, the assembly comprising:

at least one cutter head having a proximal portion, a distal portion, a cutter body, and a cutting member, wherein the distal portion of the cutter body defines a recess within which the cutting member is received, wherein the cutting member is configured to automatically cut stretched yarn that hangs below quality yarn as the stretched yarn and the quality yarn travel in the yarn direction; and at least one mounting arm having a proximal end coupled to a portion of the yarn system and a distal end coupled to the proximal portion of the cutter body, wherein the at least one mounting arm is configured to position the cutting member of the at least one cutter head a predetermined distance below a portion of the yarn system, and wherein the at least one cutter head is at a fixed position relative to the at least one mounting arm.

2. The assembly of claim 1, wherein the cutter body is sized and shaped to direct stretched yarn from the yarn system towards the cutting member.

3. The assembly of claim 2, wherein the distal portion of the cutter body comprises a snagging end and a yarn guide that tapers from the cutting member to the snagging end of the cutter body, and wherein the yarn guide is configured to direct stretched yarn from the yarn system towards the cutting member.

4. The assembly of claim 1, wherein at least a portion of the cutting member is substantially planar, and wherein the cutting member has a cutting edge positioned along a cutter longitudinal axis.

5. The assembly of claim 4, wherein the cutter longitudinal axis is substantially parallel to the longitudinal axis of the yarn system.

6. The assembly of claim 1, wherein a longitudinal axis of the at least one mounting arm is at a first arm angle relative to the longitudinal axis of the yarn system.

7. The assembly of claim 6, wherein the first arm angle is about 90 degrees.

8. The assembly of claim 6, wherein the longitudinal axis of the at least one mounting arm is positioned at a second arm angle relative to a plane bisecting the yarn system along the longitudinal axis of the system.

9. The assembly of claim 8, wherein the second arm angle is about 90 degrees.

10. The assembly of claim 8, wherein the at least one mounting arm comprises a mounting finger extending from the distal end of the at least one mounting arm, wherein a portion of the mounting finger is coupled to the at least one cutter head, and wherein the mounting finger is configured to position the cutter head in a desired position and orientation relative to the yarn system.

11. The assembly of claim 10, wherein the mounting finger has a finger longitudinal axis extending at a first finger angle relative to the longitudinal axis of the mounting arm.

12. The assembly of claim 11, wherein the first finger angle is about 90 degrees.

13. The assembly of claim 11, wherein the mounting finger is positioned in a plane at a second finger angle relative to the longitudinal axis of the mounting arm.

14. The assembly of claim 13, wherein the second finger angle is an acute angle.

15. The assembly of claim 4, wherein the at least one cutter head comprises a plurality of cutter heads, and wherein the at least one mounting arm comprises a plurality of mounting arms.

16. The assembly of claim 15, wherein the cutter longitudinal axis of the cutting member of a first cutter head of the plurality of cutter heads is substantially parallel to the cutter longitudinal axis of the cutting member of at least a second cutter head of the plurality of cutter heads.

17. The assembly of claim 15, wherein the cutter longitudinal axis of the cutting member of a first cutter head of the plurality of cutter heads is positioned so that it is a substantial mirror image of the cutter longitudinal axis of a second cutter head of the plurality of cutter heads with respect to a plane that bisects the yarn system along the longitudinal axis of the yarn system.

18. The assembly of claim 1, wherein the at least one mounting arm comprises a plurality of mounting arms, and wherein at least two mounting arms of the plurality of mounting arms are substantial mirror images of each other with respect to a plane that bisects the yarn system along the longitudinal axis of the yarn system.

19. A system comprising:

a yarn accumulator configured to accumulate yarn, wherein the yarn accumulator has a frame, an entry end, an exit end, a longitudinal axis, and an outer perimeter around which yarn is wrapped, wherein the yarn accumulator urges yarn from the entry end to the exit end in a yarn direction along the longitudinal axis; and a cutting assembly for automatically cutting stretched yarn traveling in the yarn direction, the yarn assembly comprising:

at least one cutter head having a proximal portion, a distal portion, a cutter body, and a cutting member, wherein the distal portion of the cutter body defines a recess within which the cutting member is received, wherein the cutting member is configured to automatically cut stretched yarn that hangs below quality yarn as the stretched yarn and the quality yarn are urged in the yarn direction by the yarn accumulator; and at least one mounting arm having a proximal end coupled to the frame of the yarn accumulator and a distal end coupled to the proximal portion of the cutter body, wherein the at least one mounting arm is configured to position the cutting member of the at least one cutter head a predetermined distance below the outer perimeter of the yarn accumulator, and wherein the at least one cutter head is at a fixed position relative to the at least one mounting arm.

* * * * *